US007750217B2

(12) United States Patent
Decker

(10) Patent No.: US 7,750,217 B2
(45) Date of Patent: Jul. 6, 2010

(54) INTONATED NUT WITH LOCKING MECHANISM FOR MUSICAL STRING INSTRUMENTS

(76) Inventor: Gregory Scott Decker, 865 S. Quebec #103B, Denver, CO (US) 80247

( * ) Notice: Subject to any disclaimer, the term of this patent is extended or adjusted under 35 U.S.C. 154(b) by 0 days.

(21) Appl. No.: 12/231,287

(22) Filed: Sep. 2, 2008

(65) Prior Publication Data

US 2010/0050851 A1 Mar. 4, 2010

(51) Int. Cl.
*G10D 3/06* (2006.01)

(52) U.S. Cl. ..... 84/314 N; 84/290

(58) Field of Classification Search ..... 84/314 N, 84/314 R, 293, 318, 290
See application file for complete search history.

(56) References Cited

U.S. PATENT DOCUMENTS

| | | | | |
|---|---|---|---|---|
| 4,295,404 | A | 10/1981 | Smith | |
| 4,475,432 | A | 10/1984 | Stroh | |
| 4,517,874 | A | 5/1985 | Fender | |
| D280,330 | S | 8/1985 | Tanaka | |
| 4,574,678 | A | 3/1986 | Edwards | |
| 4,667,561 | A | 5/1987 | Storey | |
| 4,669,350 | A | 6/1987 | Gressett | |
| RE32,863 | E | 2/1989 | Edwards | |
| 5,750,910 | A | 5/1998 | LoJacono | |
| 5,932,822 | A | 8/1999 | Bernstein | |
| 6,156,962 | A | 12/2000 | Poort | |
| 6,433,264 | B1 | 8/2002 | Gimpel | |
| 7,378,582 | B2 * | 5/2008 | Kinoshita | 84/314 N |

* cited by examiner

*Primary Examiner*—Jianchun Qin
(74) *Attorney, Agent, or Firm*—Leyendecker & Lemire, LLC; Terrence M. Wyles

(57) ABSTRACT

The present invention provides in combination, an intonated string nut and string locking mechanism for a musical string instrument with a fretted fingerboard where the combination intonated string nut and string locking mechanism includes a string nut fulcrum and a string locking means, where each string nut fulcrum may have a varying linear position in relation to each individual string in order to provide the optimum compensation amount for improving the consistency and production of in-tune musical notes during play for musical string instruments with fretted fingerboards.

24 Claims, 4 Drawing Sheets

INTONATED NUT WITH LOCKING MECHANISM FOR MUSICAL STRING INSTRUMENTS

FIELD OF THE INVENTION

This invention relates to musical string instruments with fretted fingerboards, and more specifically to an improved nut mechanism that incorporates a string length intonation adjustment means and a means for rigidly securing the strings in position in order to ensure tuning stability.

THE PRIOR ART

It is well known in the art that stringed musical instruments with fretted fingerboards require specific string length and string height adjustments at the bridge and at the nut fulcrum points in order for the instrument to play in tune, and also be comfortable to play. String intonation is the technique wherein the theoretical length of a string is elongated in order to compensate for the increase in pitch that naturally occurs due to an increase in a string's tension as it is deflected away from its resting position and towards the fingerboard for contact. This "compensation" allows the musical notes produced by varying a string's vibrating length at specific frets along the fingerboard to be in tune relative to each other.

Throughout most of the history of fretted string instrument manufacture, this compensation was only done at the bridge fulcrum point. During the final adjustment phase of instrument production, a luthier would pluck the string, and at a point located precisely half way between the nut and the bridge, the luthier would then lightly touch the string thereby producing the first harmonic of the open string, with that note being an octave above pitch of the open string. The luthier would then deflect the string to the twelfth fret, located precisely at one half of the string's theoretical length, and pluck it in order to produce the fretted octave note of the open string. He would then compare these harmonic octave notes and fretted octave notes repeatedly while adjusting the position of the string's bridge fulcrum point away from the nut until the harmonic and fretted notes of the string being adjusted were identical.

Unfortunately, this technique only works in regards to fretted notes. When one compares the relationship between an instrument's fretted notes, and its open string notes wherein a string is simply plucked and allowed to vibrate between its bridge and nut fulcrum points, the ideal theoretical relationship between open string frequencies and fretted string frequencies does not exist. This is because vibrating open strings are not deflected towards the fingerboard, and therefore they do not require any compensation. The open string notes will therefore be lower in frequency in relationship to the fretted notes than they should be. With this, if a player tunes his instrument to its open string notes, the only fretted note that will be in ideal relative tune with the open string's pitch will be the fretted note produced at the $12^{th}$ fret. The fretted notes above the $12^{th}$ fret will go progressively flat as you move towards the bridge, and the fretted notes below the $12^{th}$ fret will go progressively sharp as you move towards the nut. A means must be used to restore the ideal relationship between open string and fretted note frequencies.

In an attempt to correct this difficulty and allow both open stings notes and fretted notes to be in relative tune with each other, the idea of additionally compensating a string's length at the nut in order to restore the ideal ratio between open string and fretted note frequencies has found its way into the art. Non-adjustable examples of this concept can be found in U.S. Pat. No. 4,295,404, U.S. Pat. No. 6,156,962, and U.S. Pat. No. 6,433,264. And adjustable example of a compensated string nut can be found in U.S. Pat. No. 5,750,910.

Furthermore, additional difficulties in keeping the instrument in proper tune arise with the usage of vibrato mechanisms. These mechanisms allow the player to vary the tension of the strings during play in order to produce a wide range of frequency related effects, most notably vibrato, which is a periodic change in a string's frequency. These mechanisms are difficult to use in that the return of a string to its original tension is very difficult to achieve because these mechanisms typically use springs for their restoring force. Changes in temperature, friction of a string's contact points at the bridge and nut, the stability of a string's material, and variations in the holding position of a string's tuning mechanism as a string's tension changes during vibrato mechanism usage all combine to make the tuning and stability of string tensions during play very difficult to achieve.

There are a variety of mechanisms within the art that provide the player with a means for eliminating string slippage at the nut in order to improve the tuning stability of the instrument. With each mechanism, the player rigidly secures a length of each string between two flat surfaces. U.S. Pat. No. 4,517,874, U.S. Pat. No. Des. 280,330, and U.S. Pat. No. 4,475,432 show string locking mechanisms that require the usage of an allen wrench to secure the string between two flat surfaces. U.S. Pat. No. 4,574,678, U.S. Pat. No. 4,667,561, U.S. Pat. No. 4,669,350, U.S. Pat. No. 5,932,822, and U.S. Pat. No. Re. 32,863 each illustrate string locking mechanisms that can be engaged manually by the player without the need for using a tool. Any of these locking mechanisms can be used with the present invention.

OBJECTS AND ADVANTAGES

Musical note production during play and the art of musical string instrument design find advancement with the mechanical format of the present invention. The primary object of the present invention is to provide the player with a combination intonated string nut and string locking mechanism as a means for providing for the production of musical notes that are more precisely in-tune during play, and to provide for a more exacting return of string tensions to their proper levels after the usage of a vibrato mechanism for frequency related effects has been engaged.

DETAILED DESCRIPTION

Figure 1:
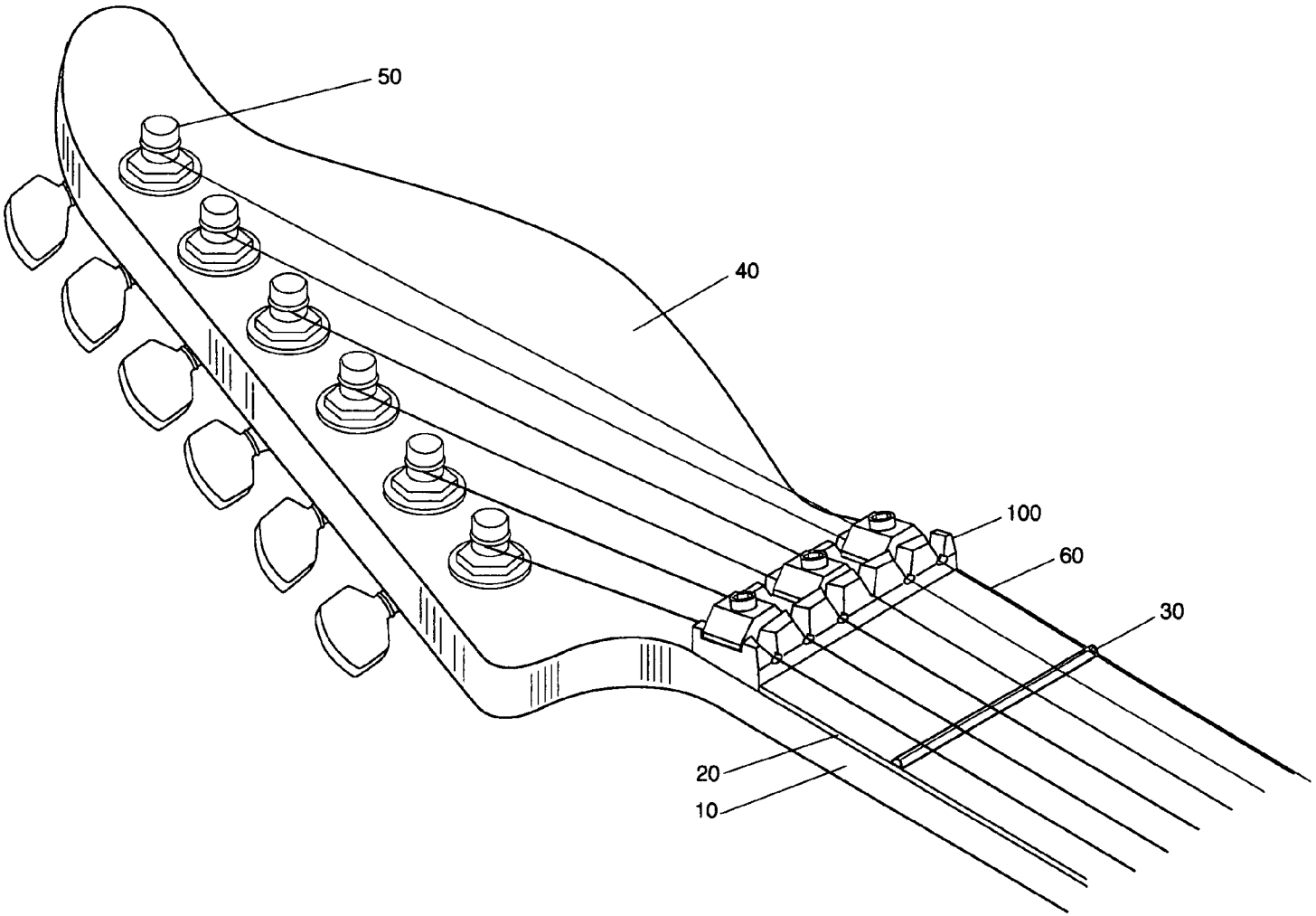
FIG. 1 Perspective view of the present invention

Referring now to the drawings, FIG. 1 illustrates a partial view of a guitar's neck 10, fingerboard 20, frets 30, headstock 40, machine heads 50, strings 60, and the combination intonated string nut and string locking mechanism of the present invention 100.

Figure 2:
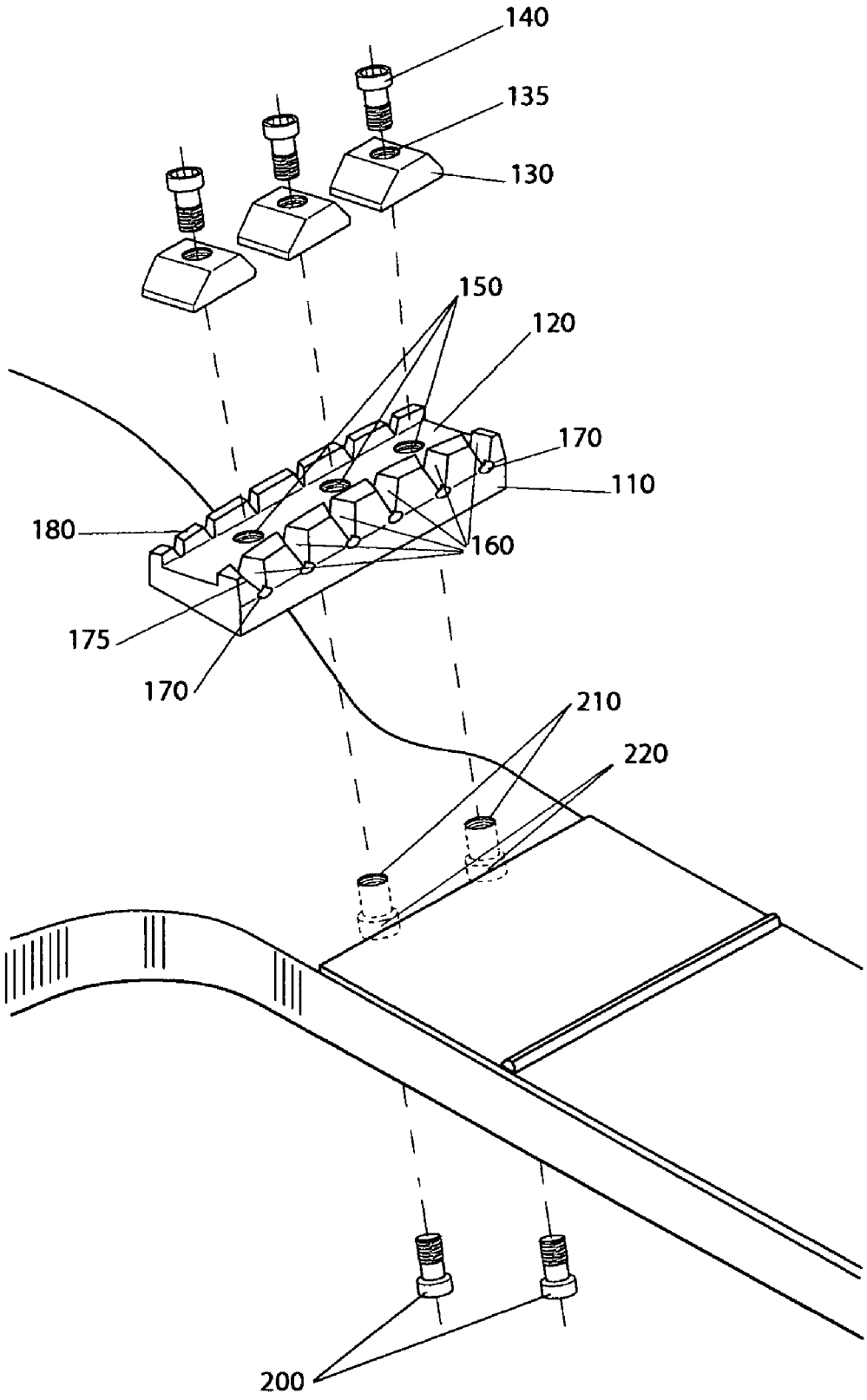
FIG. 2 Exploded perspective view of the present invention

FIG. 2 illustrates a perspective exploded view of the preferred embodiment of the present invention 100. As can be seen, the present invention 100 includes base plate 110, string locking plate channel 120, string locking plates 130 that include string locking plate slip fit through holes 135, string locking plate bolts 140, string locking plate threaded holes 150, front elongated v-shaped string guides 160, string intonation cutouts 170 with intonated string nut fulcrums 175, and rear elongated v-shaped string guides 180, string nut securing thread holes 190, and string nut securing bolts 200. Through-neck, counter-bored, slip-fit holes 210 with boss' 220 within neck 10 is a common feature used by guitar manufacturers.

By placing the present invention 100 in position above through-neck counter-bored slip-fit holes 210 wherein string nut securing thread holes 190 are in alignment with said through-neck slip-fit counter-bored holes 210, and then by placing string nut securing bolts 200 within said through-neck slip-fit counter-bored holes 210, and rotating said string nut securing bolts 200 until they engage with and are rigidly torqued against the threads of string nut securing thread holes 190 and boss 220 of said through-neck counter-bored slip-fit holes 210, the present invention 100 finds rigid position securement on the instrument at the proper location between fingerboard 20 and headstock 40 on neck 10.

Front elongated v-shaped string guides 160, intonation cutouts 170 with intonated string nut fulcrums 175, and rear elongated v-shaped string guides 180 provide the means for guiding and positioning the strings 60 in the proper location while also providing the means for supplying the additional compensated string length required for the open string notes and the fretted string notes to stay in relative tune with each other during play. The elongated v-shape of each front elongated v-shaped string guide 160 and rear elongated v-shaped string guide 180 helps to aid in the initial attachment and final positioning of the string. The side of each string guide provides a surface for the string to follow to its final position located in the bottom center where the intonated string nut fulcrums 175 are located.

Figure 3:
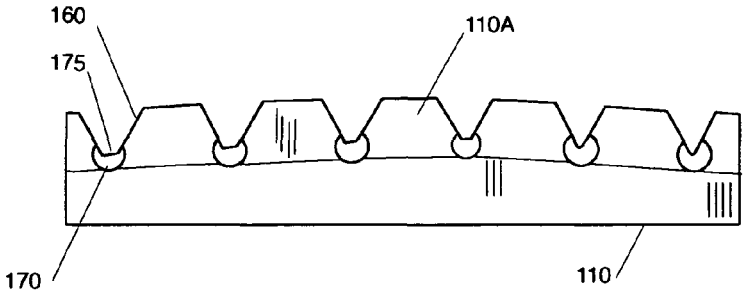
FIG. 3 Front view of the main plate of the present invention.

FIG. 3 shows a front view of base plate 110. As can be seen, front elongated v-shaped string guides 160, string intonation cutouts 170, and the fronts of the intonated string nut fulcrums 175 are shown. In the manufacturing process, a small endmill was used to fabricate the string intonation cutouts 170, and the depth of each of the intonated string nut fulcrums 175 in a single plunging operation. The circular shape of each of the string intonation cutouts 170 was found to be very beneficial in that a minimum of material needed be removed, and it provides for a smooth top edge of the front of base plate 110 thereby eliminating any potential for accidental damage to the player's hand.

Figure 4:
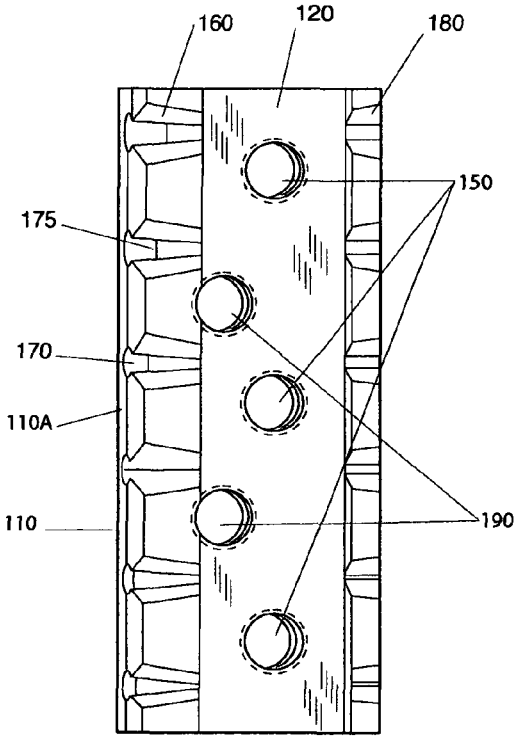
FIG. 4 Top view of the main plate of the present invention.

A top view of base plate 110 is shown in FIG. 4. This figure clearly shows the varying depths of each of the string intonation cutouts 170 relative to the front face 110*a*, and therefore the varying linear position of each string's intonated string nut fulcrum 175 thereby providing for the desired amount of compensation for each string. As can be appreciated, the ideal compensated length amount for each string will vary with the overall scale length of the instrument, and with the diameter and type of strings chosen by the player. String locking plate channel 120, String locking plate thread holes 150, rear elongated v-shaped string guides 180, and string nut securing thread holes 190 are also shown.

Figure 5:
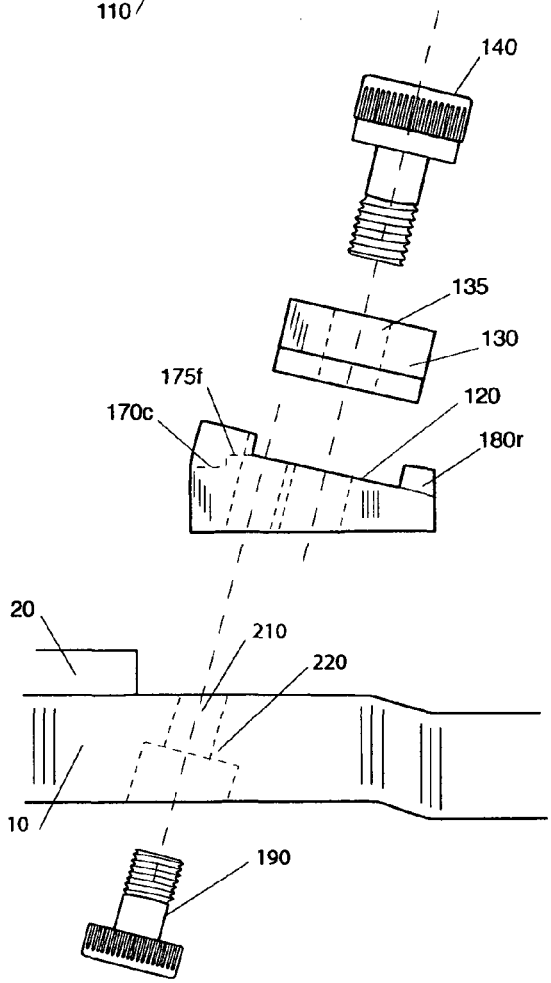
FIG. 5 Exploded side view of present invention

In FIG. 5, an exploded side view of the present invention is shown. Dashed lines 170*c* and 175*f* illustrate the configuration of string intonation cutouts 170, and intonated string nut fulcrums 175. Dashed line 180*r* illustrates the bottom face of rear elongated v-shaped string guide 180. By slipping string locking plate bolt 140 through string locking plate slip fit through hole 135 of string locking plate 130, aligning it with string locking plate threaded hole 150 and rotating it until the bottom surface of the head of string locking plate bolt 140 is in contact with the top of string locking plate 130 and the threads of string locking plate bolts 140 are securely torqued against the complementary mating threads of string locking plate threaded holes 150 by means of a wrench, each string will be compressed and rigidly held in position between the fixed surface at the bottom of s string locking plate channel 120 and the bottom face of string lock 130 thereby providing for an improvement in string tension stability especially when used in combination with a vibrato mechanism.

Figure 6:
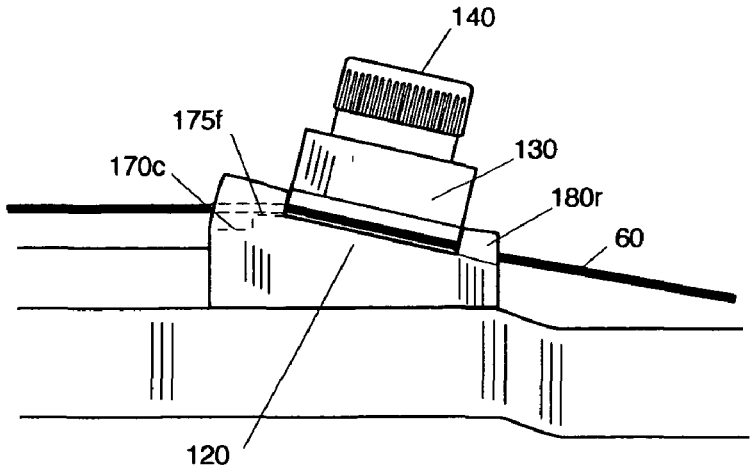
FIG. 6 Assembled side view of the present invention

FIG. 6 illustrates an assembled side view of the present invention. As can be seen by the dashed line 170*c*, string intonation cutout 170 provides relief below string 60, and the bottom of string 60 is in contact with intonated string nut fulcrum illustrated by dashed line 175*f*. It can also be seen that the depth of string intonation cutout 170 determines the linear position of the front of intonated string nut fulcrum 175, and therefore the amount of intonation provided to each string 60. The locking feature of the present invention is also clearly indicated. As is seen, a portion of each string 60 is rigidly compressed between the bottom of string locking plate channel 120 and the bottom of string locking plate 130.

Figure 7:
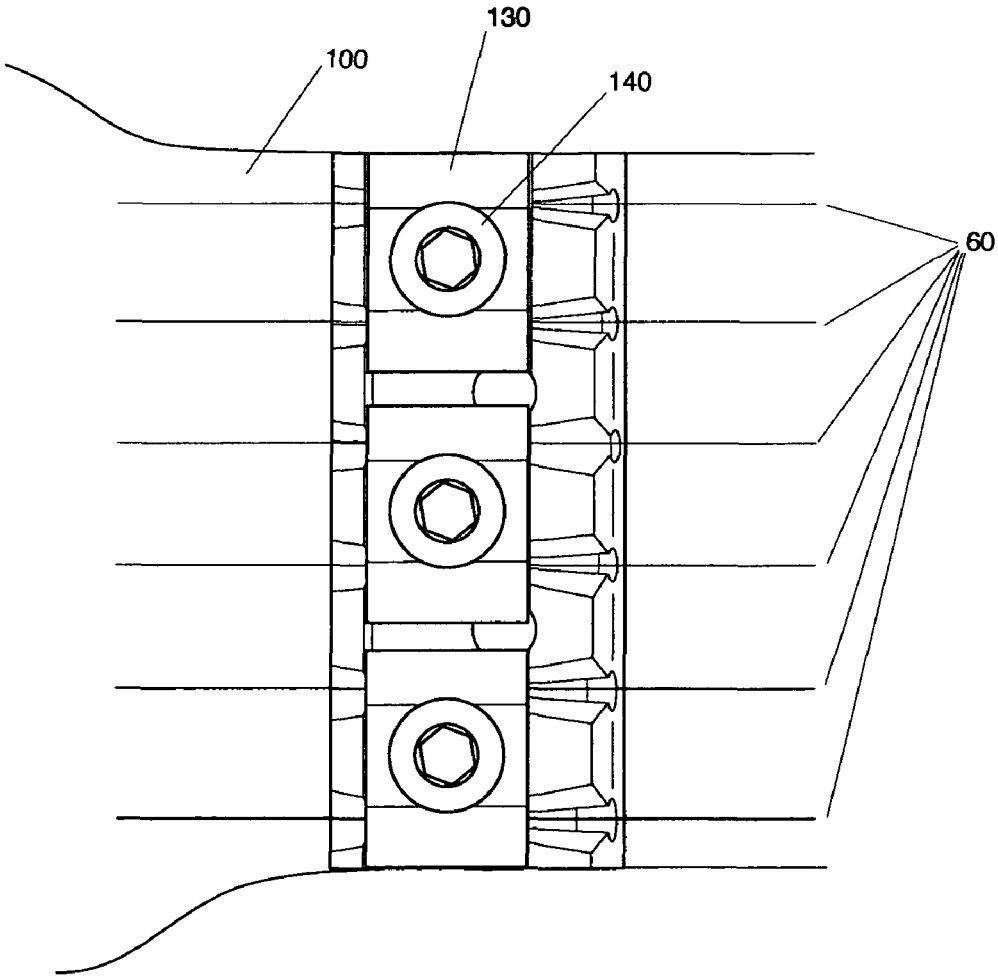
FIG. 7 Assembled top view of the present invention

A top view of the present invention fully assembled is seen in FIG. 7. As is clearly seen, each string is provided a specific amount of compensation, and each is rigidly locked into linear position by means of compressing each string between a fixed surface and a variable height surface.

I claim:

1. In combination, an intonated string nut and string locking mechanism for a musical string instrument with a fretted fingerboard wherein said combination intonated string nut and string locking mechanism includes:

a string nut fulcrum for each individual string, wherein each said string nut fulcrum has a varying linear position in relation to each said individual string, wherein each said string nut fulcrum is positioned at a varying depth relative to a front face of said combination intonated string nut and string locking mechanism in order to provide the ideal amount of linear compensation for each of said strings, whereby said varying linear position provides the optimum compensation amount for each said individual string, when each said individual string is caused to vibrate between a bridge fulcrum and said string nut fulcrum, and whereby as a result of said optimum compensation, the musical notes produced will be in tune relative to each other when each said individual string is caused to vibrate between said bridge fulcrum and any one of a plurality of fret fulcrums; and a string locking means, wherein said string locking means provides a rigid linear position securability of each of said individual strings at each of said string nut fulcrums by means of compressing each of said strings between a first rigid surface with a fixed position and a second rigid surface that is height adjustable and position lockable.

2. The combination intonated string nut and string locking mechanism of claim 1, further including a string positioning mechanism for each of said strings.

3. The combination intonated string nut and string locking mechanism of claim 2, wherein each said string positioning mechanism includes:

a first v-shaped string guidance channel located at a front face of said combination intonated string nut and string locking mechanism; and a second v-shaped string guidance channel located at a rear face of said combination intonated string nut and string locking mechanism.

4. The combination intonated string nut and string locking mechanism claim 3, wherein said first v-shaped string guidance channel and said second v-shaped string guidance channel are separated by a distance.

5. The combination intonated string nut and string locking mechanism of claim 3, wherein said first rigid surface with a fixed position is located between said first v-shaped string guidance channel and said second v-shaped string guidance channel.

6. The combination intonated string nut and string locking mechanism of claim 3, wherein said second rigid surface is a bottom surface of a height-adjustable and position-securable rigid plate-like means.

7. The combination intonated string nut and string locking mechanism of claim 6, wherein the height-adjustable and position-securable rigid plate-like means includes a through hole.

8. The combination intonated string nut and string locking mechanism of claim 7, wherein said height-adjustable and position-securable rigid plate-like means slip-fits between said first v-shaped string guidance channel and said second v-shaped guidance channel, and above said first rigid surface.

9. The combination intonated string nut and string locking mechanism of claim 7, wherein:

(i) a base of said combination intonated string nut and string locking mechanism includes one or more thread holes, and (ii) said position height adjustability and said position securability is achieved by means of a threaded bolt used in combination with said through hole, one of said one or more thread holes, and a torquing tool.

10. The combination intonated string nut and string locking mechanism of claim 6, wherein the height-adjustable and position-securable rigid plate-like means provides position securability for one or more of said strings.

11. The combination intonated string nut and string locking mechanism of claim 1, wherein a base of said combination intonated string nut and string locking mechanism includes one or more thread holes.

12. A method of making a combination intonated string nut and string locking mechanism for a musical string instrument with a fretted fingerboard, comprising the steps of:

providing a string nut fulcrum for each individual string, wherein each said string nut fulcrum has a varying linear position in relation to each said individual string, wherein each said string nut fulcrum is positioned at a varying depth relative to a front face of said combination intonated string nut and string locking mechanism in order to provide the ideal amount of linear compensation for each of said strings, whereby said varying linear position provides the optimum compensation amount for each said individual string, when each said individual string is caused to vibrate between a bridge fulcrum and said string nut fulcrum, and whereby as a result of said optimum compensation, the musical notes produced will be in tune relative to each other when each said individual string is caused to vibrate between said bridge fulcrum and any one of a plurality of fret fulcrums; and providing a string locking means, wherein said string locking means provides a rigid linear position securability of each of said individual strings at each of said string nut fulcrums by means of compressing each of said strings between a first rigid surface with a fixed position and a second rigid surface that is height adjustable and position lockable.

13. The method of claim 12, further comprising the step of:

during the step of providing said string nut fulcrum for each individual string, fabricating a string-intonation cutout for each string nut fulcrum to form intonated string nut fulcrums, whereby each said string nut fulcrum is positioned at said depth relative to a front face of said combination intonated string nut and string locking mechanism in order to provide the ideal amount of linear compensation for each of said strings.

14. The method of claim 13, wherein each said cutout is substantially circular in shape, and whereby as a result the top edge of the front base of said combination intonated string nut and string locking mechanism remains substantially smooth.

15. The method of claim 12, wherein further comprising the step of providing a string positioning mechanism for each of said strings.

16. The method of claim 15, wherein each said string positioning mechanism includes:

a first v-shaped string guidance channel located at a front face of said combination intonated string nut and string locking mechanism; and a second v-shaped string guidance channel located at a rear face of said combination intonated string nut and string locking mechanism.

17. The method of claim 16, wherein said first v-shaped string guidance channel and said second v-shaped string guidance channel are separated by a distance.

18. The method of claim 16, wherein said first rigid surface with a fixed position is located between said first v-shaped string guidance channel and said second v-shaped string guidance channel.

19. The method of claim 16, wherein said second rigid surface is a bottom surface of a height-adjustable and position-securable rigid plate-like means.

20. The method of 19, wherein the height-adjustable and position-securable rigid plate-like means includes a through hole.

21. The method of claim 20, wherein said height-adjustable and position-securable rigid plate-like means slip-fits between said first v-shaped string guidance channel and said second v-shaped guidance channel, and above said first rigid surface.

22. The method of claim 20, wherein:

(i) a base of said combination intonated string nut and string locking mechanism includes one or more thread holes, and (ii) said position height adjustability and said position securability is achieved by means of a threaded bolt used in combination with said through hole, one of said one or more thread holes, and a torquing tool.

23. The method of claim 19, wherein the height-adjustable and position-securable rigid plate-like means provides position securability for one or more of said strings.

24. The method of claim 12, wherein a base of said combination intonated string nut and string locking mechanism includes one or more thread holes.

* * * * *